United States Patent [19]

Rich

[11] Patent Number: 4,593,946

[45] Date of Patent: Jun. 10, 1986

[54] DOOR BRACKET FOR USE IN VEHICLE BODYWORK

[76] Inventor: John W. Rich, Rte. 1, Box 228, Elburn, Ill. 60119

[21] Appl. No.: 513,787

[22] Filed: Jul. 15, 1983

Related U.S. Application Data

[63] Continuation of Ser. No. 100,337, Dec. 5, 1979, abandoned.

[51] Int. Cl.[4] ..... E05C 19/18

[52] U.S. Cl. ..... 292/288; 292/339; 292/262

[58] Field of Search ..... 292/216, 288, 258, 339, 292/244, 262, 338

[56] References Cited

U.S. PATENT DOCUMENTS

| | | | |
|---|---|---|---|
| 598,405 | 2/1898 | Williams | 292/339 |
| 2,618,497 | 11/1952 | Gardels | 292/288 X |
| 2,671,355 | 3/1954 | Hawkins | 292/288 X |
| 3,180,668 | 4/1965 | Brown | 292/288 X |
| 3,400,961 | 9/1968 | Koch et al. | 292/216 |
| 3,432,198 | 3/1969 | Connor | 292/216 |
| 3,633,390 | 1/1972 | Wartian | 292/DIG. 14 |
| 3,744,831 | 7/1973 | Joseph et al. | 292/244 |
| 3,781,046 | 12/1973 | Hinkle | 292/288 X |
| 4,070,050 | 1/1978 | Glock et al. | 292/339 |
| 4,157,128 | 6/1979 | Peters | 292/339 |

*Primary Examiner*—Richard E. Moore

*Attorney, Agent, or Firm*—Knechtel & Demeur

[57] ABSTRACT

A rigid elongate bracket is provided which has at one end a disc-shaped lug generally corresponding to the lug on the door frame which is designed to interact with the door latch on the door of a vehicle, and has at the other end a hook-shaped member adapted to grasp the lug on the door frame, whereby the bracket can be fitted to hold the door in a partially open position while bodywork is being performed on the vehicle. The bracket preferably has a telescoping feature whereby the door edge can be anchored at different distances from the door frame.

5 Claims, 4 Drawing Figures

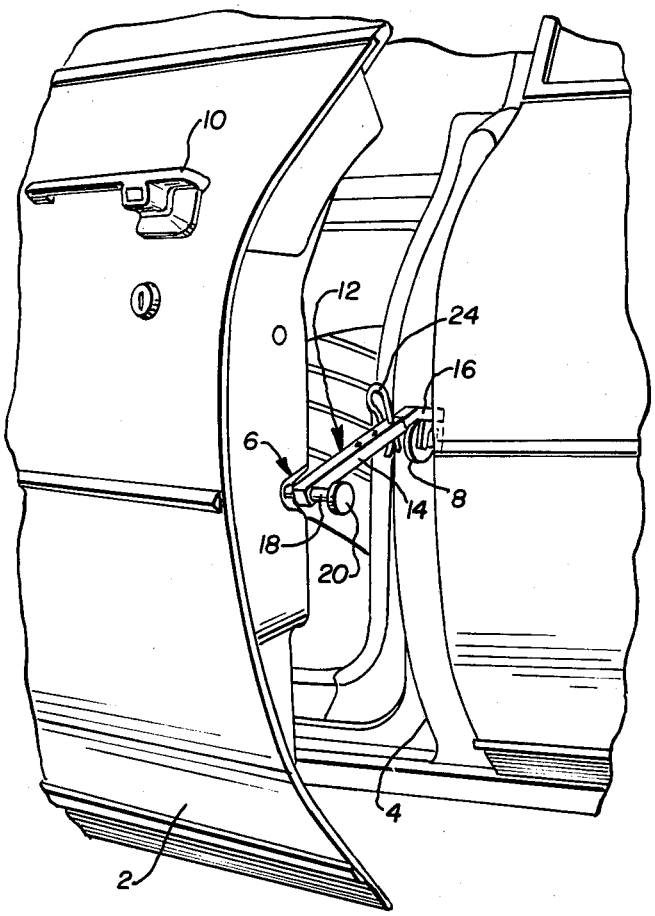
FIG. 1
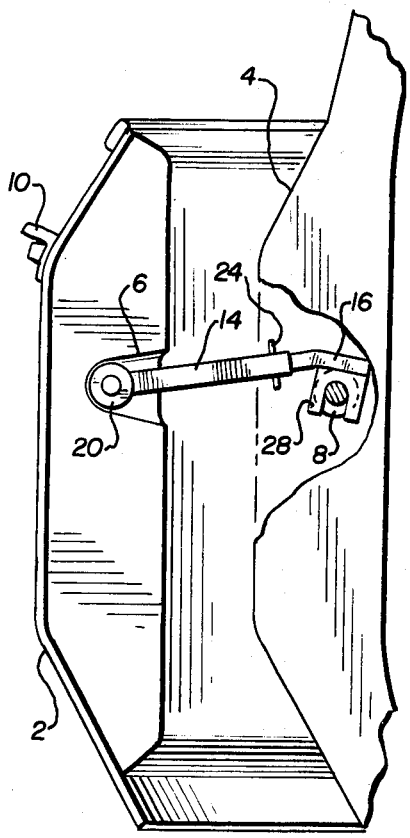
FIG. 4
FIG. 2
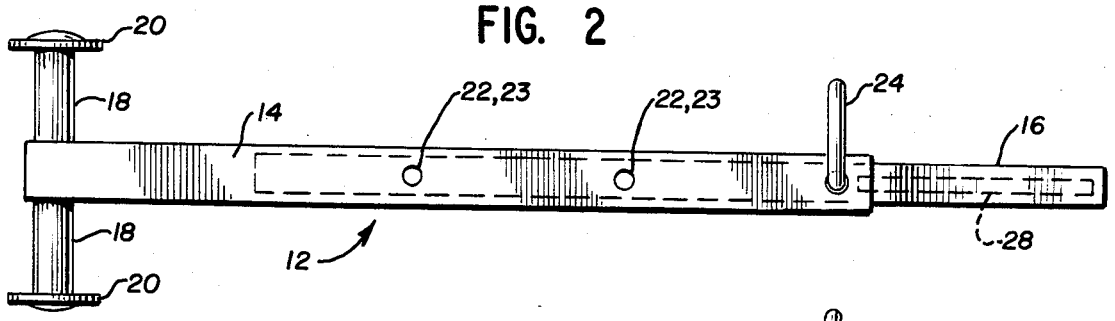
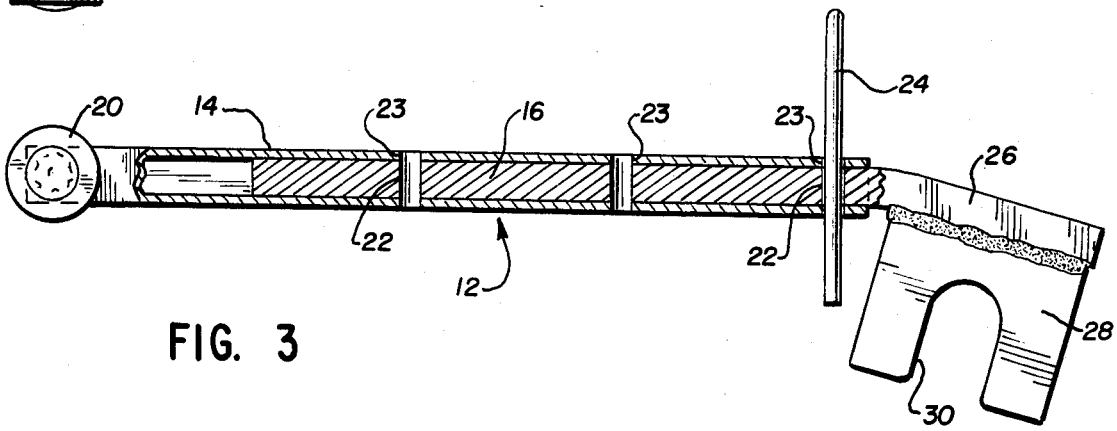
FIG. 3

DOOR BRACKET FOR USE IN VEHICLE BODYWORK

This application is a continuation of application Ser. No. 100,337, filed 12-5-79, now abandoned.

BACKGROUND OF THE INVENTION

1. Field of the Invention

Tools and fixtures for use in performing bodywork on vehicles such as cars, vans and trucks.

2. Description of the Prior Art

When reconstruction and refinishing of doors and body panels on vehicles is being performed it is frequently necessary or convenient to hold the edges of a door in a spaced relation to an adjacent door, door frame or body panel. In the past, mechanics have resorted to various crude means to brace a door in an open position while grinding, sanding, filling and painting are being performed on the door and/or adjacent panels. Such improvised means might comprise the combination of a stick of wood, wire and rope, as examples. These means take time to rig, are unwieldy, are not always adequate for the purpose, and are not universally adaptable to all vehicles.

SUMMARY OF THE INVENTION

In accordance with this invention we have conceived a need for a tool which can be quickly installed on almost any conventional vehicle to hold a hinged door in a partially open and rigidly braced position in order to facilitate bodywork. This invention takes advantage of the matching configurations of the typical disc-shaped lugs on the door frame which snaps into the latch on the door. A bracket is provided which has at one end a lug functionally corresponding to the lug on the door frame and which similarly snaps into the latch on the door, and at its other end has a hook-like means adapted to grasp said lug on the door frame. The elongate bracket member can be telescoped by various means, such as a cotter pin insertable into matching holes in the two members as disclosed according to one embodiment of the invention.

BRIEF DESCRIPTION OF THE DRAWINGS

FIG. 1 is a perspective view of the combination of an automobile and a bracket fitted thereon to hold the door open in accordance with this invention;

FIG. 2 is a top or plan view of the bracket as used;

FIG. 3 is a side view, partially in section, of the bracket shown in FIG. 2; and FIG. 4 is a side view of the end of the door and the door frame, in partial section, with the aforesaid bracket in place.

DESCRIPTION OF PREFERRED EMBODIMENT

Referring particularly to FIG. 1, there is illustrated a left-front side of an automobile having a partially open door 2 and an intermediate door post 4, the door having a typical snap-action latch designated at 6, and the laterally facing side of the door frame having a lug 8 which is adapted to interlock with the latch 6 when the door is closed. Release of the latch 6 and lug 8 is effected by operation of the usual pushbutton handle 10.

Generally indicated at 12 is a substantially rigid bracket comprising, according to this particular embodiment, a rigid elongate hollow outer channel member 14 and a rigid inner telescoping member 16. A pin 18, welded or otherwise affixed to member 14, projects laterally from both sides and has planar disc-shaped lugs 20 affixed to its distal ends. Each disc-shaped lug 20 sufficiently corresponds to the shape of the frame-mounted lug 8 as to comprise a surrogate thereof when snapped into the door latch 6.

Means of securing telescoping members 14 and 16 comprises holes 22 drilled into the inner member 16 and aligned holes 23 drilled into the outer member 14; a cotter pin 24 inserted through holes 22, 23 serves to lock members 14 and 16 in any of several available lengths which rigidly determine the angle at which a door is held in an open position.

The outer end 26 of inner member 16 is bent at an angle as shown in FIG. 3, and has a rigid blade 28 extending downwardly, with a slot or hook 30 being formed therein to fit over the pin supporting the lug 8 on the laterally facing end wall of the door frame of a typical vehicle.

In operation, instead of improvising makeshift devices to hold a door open while work is being done on the door or an adjacent body member, the bracket 12—in a matter of seconds—is simply snapped into place with one of the lugs 20 being received by the latch 6, and with the hook 30 downwardly affixed around and grasping the corresponding lug 8 on the end wall of the vehicle door frame.

It is significant to note that the bracket 12 can be used equally on a left or right-handed door, by virtue of the two laterally spaced disc-shaped lugs 20 that extend from both sides thereof.

I claim:

1. For use with a vehicle having a body and a door pivotal around a substantially vertical axis and movable between an open and a closed position with respect to the body, either said door or said body having a latch mechanism and the other of said door or said body having a lock element, wherein the latch mechanism releasably lockingly engages the lock element on the other side of said door or said body when said door is in its closed position, a device for holding the door in a predetermined open position comprising:

an elongated member;

first means secured to one end of the elongated member for releasably lockingly engaging the latch mechanism;

second means secured to the other end of the elongated member for releasably lockingly engaging the lock element; and wherein the lock element comprises a cylindrical striker pin and wherein said first means comprises a cylindrical pin substantially identical to said lock element wherein said second means comprises a pair of elongated tabs extending laterally outwardly from at least one side of said elongated member, said tabs being spaced apart by an amount sufficient to receive the striker pin therebetween; and wherein with said first means attached to said latch mechanism, said elongated member extends substantially horizontally so that the weight of the device maintains the locking engagement between said second means and the lock element.

2. The invention as defined in claim 1 wherein the axis of the cylindrical pin is lateral with respect to the axis of the elongated member whereby upon insertion of the cylindrical pin into said latch mechanism, said elongated member can pivot about the axis of the cylindrical pin.

3. For use with a vehicle having a left and right side, a body and at least one door movable between an open and a closed position with respect to the body, said door being on either the right or left side of the body, either said door or said body having a latch mechanism and the other of said door or said body having a lock element, wherein said latch mechanism releasably lockingly engages the lock element on the other side of said door or said body when said door is in its closed position, a device for holding the door in a pre-determined open position comprising:

an elongated member;

first means secured to one end of the elongated member for releasably lockingly engaging the latch mechanism on either side of said vehicle;

second means secured to the other end of the elongated member for releasably lockingly engaging the lock element on either side of the vehicle; and wherein the lock element comprises an elongated striker pin and wherein said second means further comprises a pair of elongated tabs extending laterally outwardly from at least one lateral side of said elongated member, said tabs being spaced apart by an amount sufficient to receive the striker pin therebetween.

4. The invention as defined in claim 3, wherein said tabs extend laterally outwardly from the elongated member.

5. The invention as defined in claim 4 wherein said first means comprises a cylindrical pin extending laterally outwardly from said rod whereby upon insertion of said cylindrical pin into said latch mechanism, said elongated member can pivot about the axis of said pin and wherein the longitudinal axis of the tabs are substantially tangential to an arc circumscribed by the pivotal action of said elongated member.

* * * * *